US008894464B2

(12) United States Patent
Chan et al.

(10) Patent No.: US 8,894,464 B2
(45) Date of Patent: Nov. 25, 2014

(54) TOY WITH FOLDING RETRACTABLE WINGS

(75) Inventors: Albert Wai Tai Chan, Taipei (TW); Ka Hung (William) Ko, Ma On Shan (CN)

(73) Assignee: Thinking Technology Inc. (BS)

( * ) Notice: Subject to any disclaimer, the term of this patent is extended or adjusted under 35 U.S.C. 154(b) by 285 days.

(21) Appl. No.: 13/318,402

(22) PCT Filed: May 3, 2010

(86) PCT No.: PCT/CA2010/000690

§ 371 (c)(1),
(2), (4) Date: Feb. 20, 2012

(87) PCT Pub. No.: WO2010/124399

PCT Pub. Date: Nov. 4, 2010

(65) Prior Publication Data

US 2012/0190270 A1 Jul. 26, 2012

(30) Foreign Application Priority Data

May 1, 2009 (CA) ..... 2665217

(51) Int. Cl.
*A63H 27/00* (2006.01)

(52) U.S. Cl.
USPC ..... 446/268; 446/309

(58) Field of Classification Search
USPC ..... 446/268, 309, 317
See application file for complete search history.

(56) References Cited

U.S. PATENT DOCUMENTS

| | | | | | |
|---|---|---|---|---|---|
| 2,221,012 | A | * | 11/1940 | Walker | 446/62 |
| 2,810,985 | A | * | 10/1957 | Bilder | 446/56 |
| 3,006,109 | A | * | 10/1961 | Boese | 446/34 |
| 7,380,285 | B1 | | 6/2008 | Moreno | |
| 2005/0191936 | A1 | | 9/2005 | Marine et al. | |
| 2006/0270307 | A1 | | 11/2006 | Montalvo et al. | |
| 2009/0075550 | A1 | | 3/2009 | Sun et al. | |

FOREIGN PATENT DOCUMENTS

| | | | |
|---|---|---|---|
| CN | 2437377 | | 7/2001 |
| WO | 2007010264 | | 1/2007 |
| WO | 2010042911 | A2 | 4/2010 |
| WO | 2010124399 | | 11/2010 |

OTHER PUBLICATIONS

European Search Report for corresponding application EP 10769204.8 mailed Mar. 7, 2013, 6 pages.
"PCT International Search Report for PCT/CA2010/000690 dated Jul. 13, 2010, from which the instant application is based," 2 pgs.

* cited by examiner

*Primary Examiner* — Vishu K. Mendiratta
(74) *Attorney, Agent, or Firm* — Fredrikson & Byron, P.A.

(57) ABSTRACT

A toy with folding retractable wings includes a body and wings connected to the body via snap-in pivot articulations that allow the folding of the wings in a space minimizing nesting configuration. Various springs, latches, triggers and stopping mechanisms ensure that the folded wings deploy in a spring-loaded fashion, with minimal user effort. The pivot articulations can release the wings in a non-destructive manner when exposed to high mechanical stress loads, thus preventing destructive wing breakage.

3 Claims, 21 Drawing Sheets

TOY WITH FOLDING RETRACTABLE WINGS

This application is a 35 U.S.C. 371 national stage filing from International Application No. PCT/CA2010/000690 filed May 3, 2010, and claims priority to Canadian Application No. 2665217 filed May 1, 2009, the teachings of which are incorporated herein by reference.

FIELD OF THE INVENTION

This invention relates to toys with retractable wings or similar extensions.

BACKGROUND

In the field of toys, it is known to have retractable wings or similar extensions. Owing to the materials and the structures used, however, such wings had the tendency to break when extended, or to bend unduly, or to be overly heavy to avoid such breakage. For example, resistance to breakage in the prior art has been effected by making the wings out of soft or elastic material such as foam or rubber, with the unavoidable side effect of being unable to provide a crisp and precise wing deployment and a long wing that would not wobble. Alternatively, a rigid, long, crisp and breakage-resistant toy wing construction is known in the prior art but it generally involves either using thin and very expensive materials of construction, or using extra thick, less expensive materials that impart undue bulkiness to the toy.

Accordingly, it would be desirable to have a toy with wings which avoided these problems with prior art toys. In particular, it would be desirable to have a toy with folding and retractable wings that could be simultaneously:

- crisp and precise in their deployment (folding, unfolding, retracting, extending);
- long, wide, thin and lightweight;
- of a high longitudinal rigidity when extended;
- unobtrusive and compact when folded and retracted;
- resistant to breakage or permanent deformation upon abusive bending/twisting and upon high energy impact with hard surface;
- amenable to tool-less, fool-proof, snap-in-place assembly and disassembly;
- amenable to push-button, instant deployment;
- difficult to misplace or lose when disassembled from the toy body;
- made of common and inexpensive plastics that are economical to manufacture and easy to process.

SUMMARY OF THE INVENTION

The present invention answers, to a substantial degree, the long felt need for folding and retractable toy wings that combine all of the above mentioned desired characteristics into one package.

Accordingly, in a principal aspect of the present invention, a toy is provided with folding and retractable wings that are:

- crisp and precise in their deployment (folding, unfolding, retracting, extending);
- long, wide, thin and lightweight;
- of a high longitudinal rigidity when extended;
- unobtrusive and compact when folded and retracted;
- resistant to breakage or permanent deformation upon abusive bending/twisting and upon high energy impact with hard surface;
- amenable to tool-less, fool-proof, snap-in-place assembly and disassembly;
- amenable to push-button, instant deployment;
- difficult to misplace or lose when disassembled from the toy body;
- made of common and inexpensive plastics that are economical to manufacture and easy to process.

These and other aspects and advantages of the present invention will be apparent to those skilled in the art upon consideration of the following detailed description in conjunction with the accompanying drawings.

BRIEF DESCRIPTION OF THE DRAWINGS

FIG. 9B is a perspective view of the backpack cover shown in FIG. 9A showing an inside surface of the backpack cover.

DETAILED DESCRIPTION OF THE PREFERRED EMBODIMENT

Figure 1:
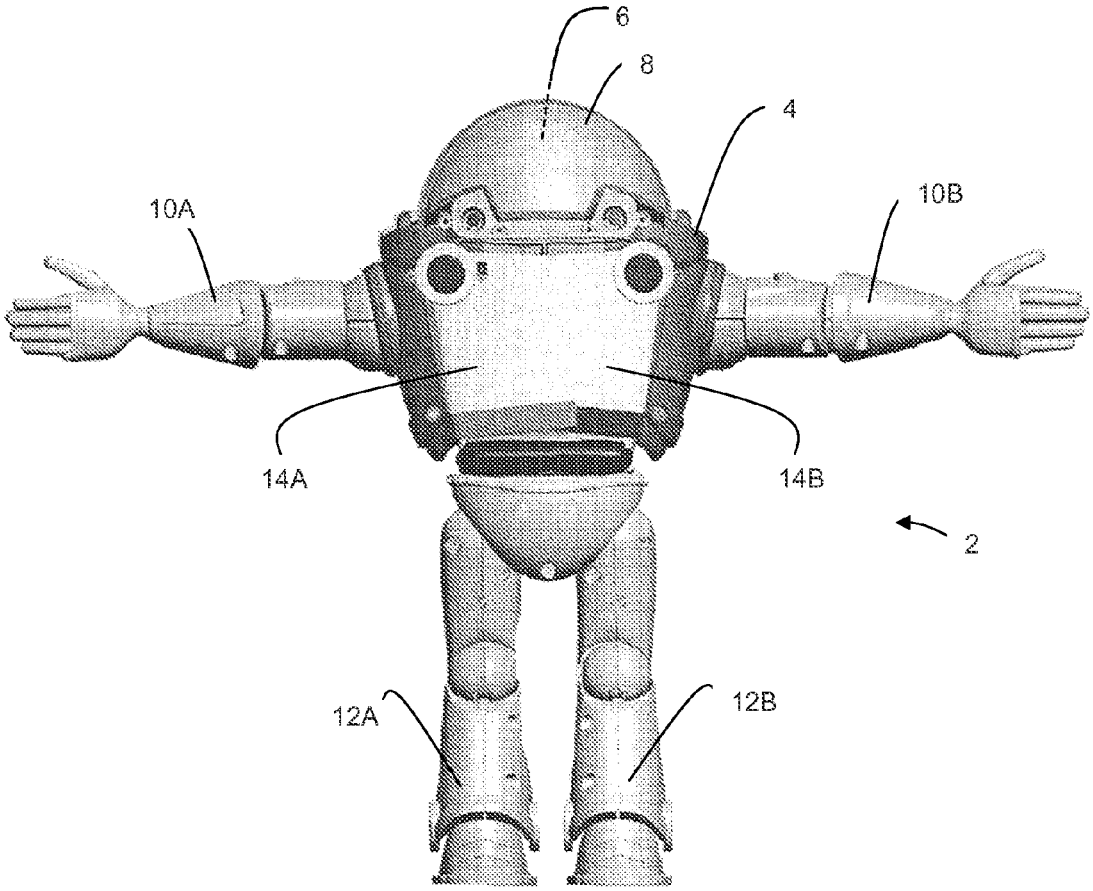
FIG. 1 is a rear elevation view of the preferred embodiment, with the wings folded and retracted.

FIG. 1 shows a toy 2 in accordance with a preferred embodiment. The toy 2 has a body 4, a head 6 with a space helmet 8, two arms 10A, 10B, two legs 12A, 12B, and two folding and retractable wings 14A, 14B. When folded and retracted as shown in FIG. 1, the wings 14A, 14B are nested one under the other on the back of the toy 2. A backpack cover 16 substantially covers the wings 14A, 14B in their nested position, to hide the folded wings from sight and to impart a more esthetically pleasing and streamlined look to the toy 2.

As shown in FIG. 9B, the backpack cover 16 has an outside surface 18, and an inside surface 20 normally facing the wings 14A, 14B. In alternative embodiments, the backpack cover 16 can be absent, without substantially affecting the functioning of the toy 2. FIG. 9B also illustrates a view of the inside surface 20 of the backpack cover 16, showing a knob 13 positioned to engage a retraction latch release lever 15 (shown in FIG. 18) on the wings 14A, 14B.

Figure 4:
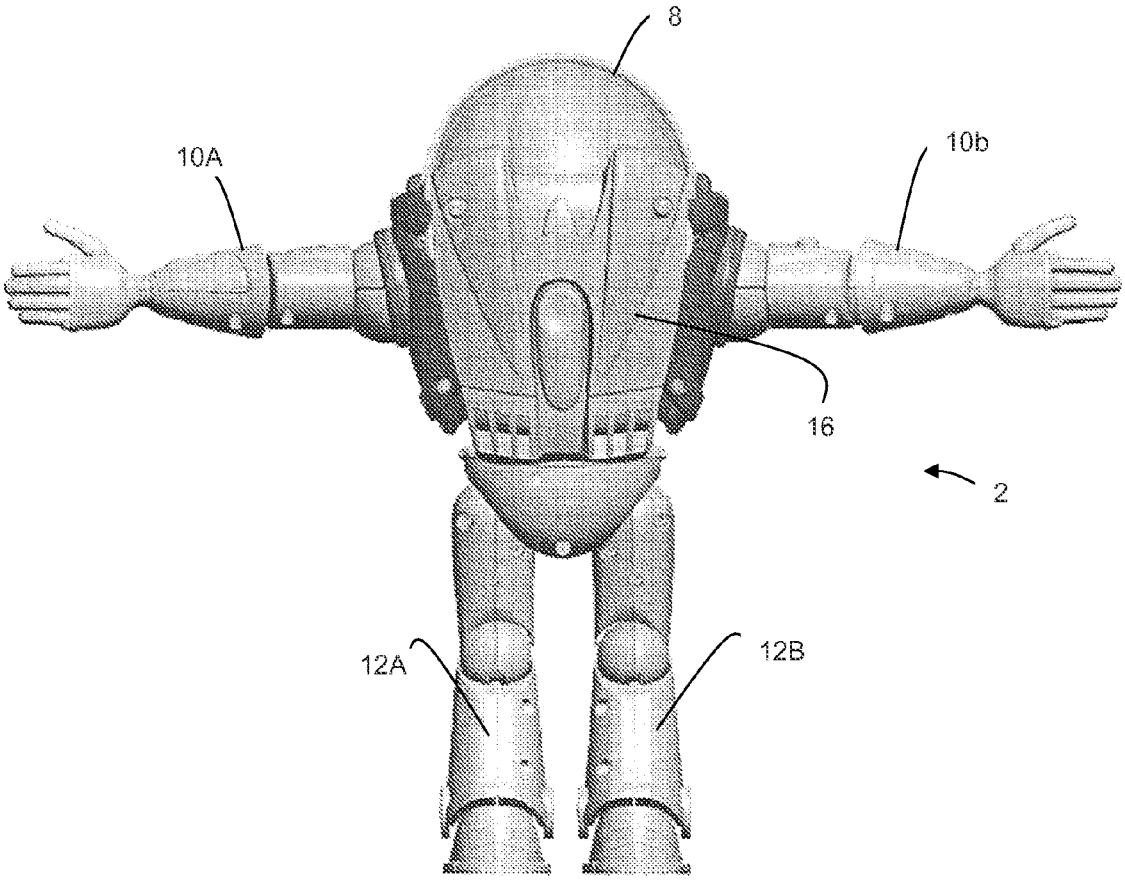
FIG. 4 is a rear elevation view of the preferred embodiment, with the wings folded and retracted, and the backpack cover in place.
Figure 5:
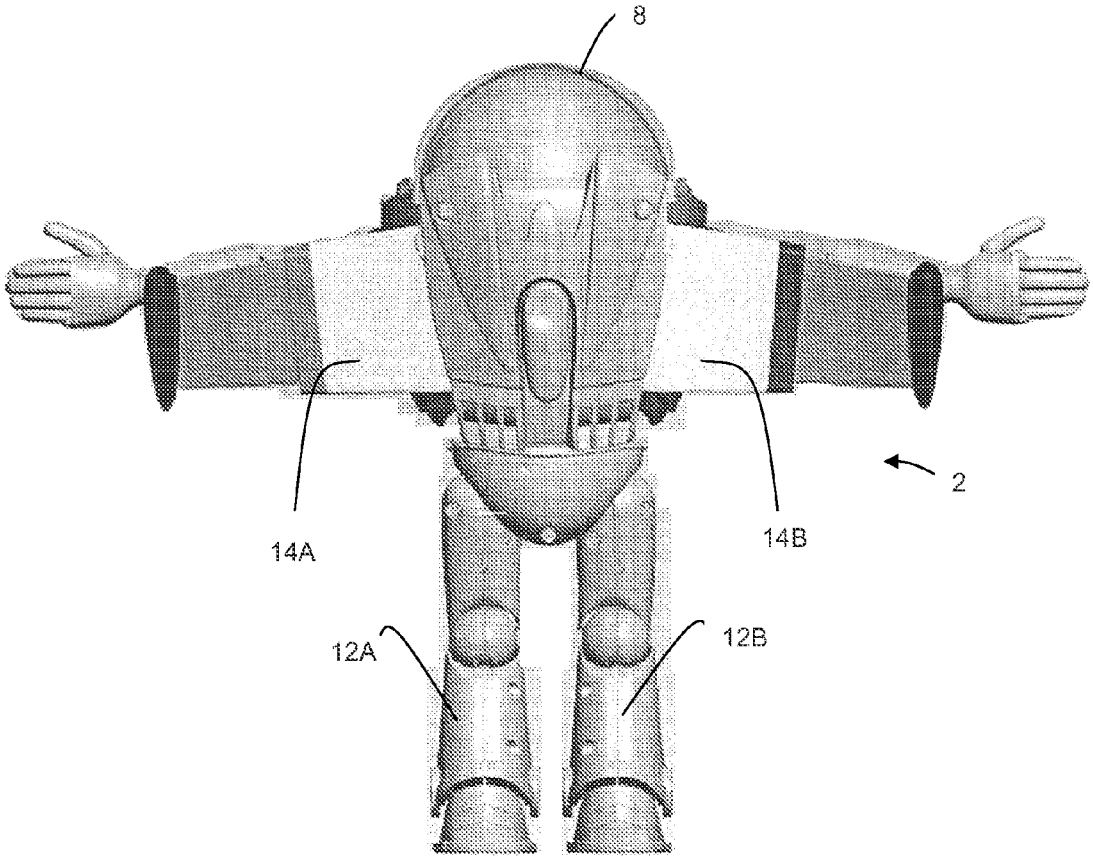
FIG. 5 is a rear elevation view of the preferred embodiment, with the wings unfolded and extended, and the backpack cover in place.
Figure 6:
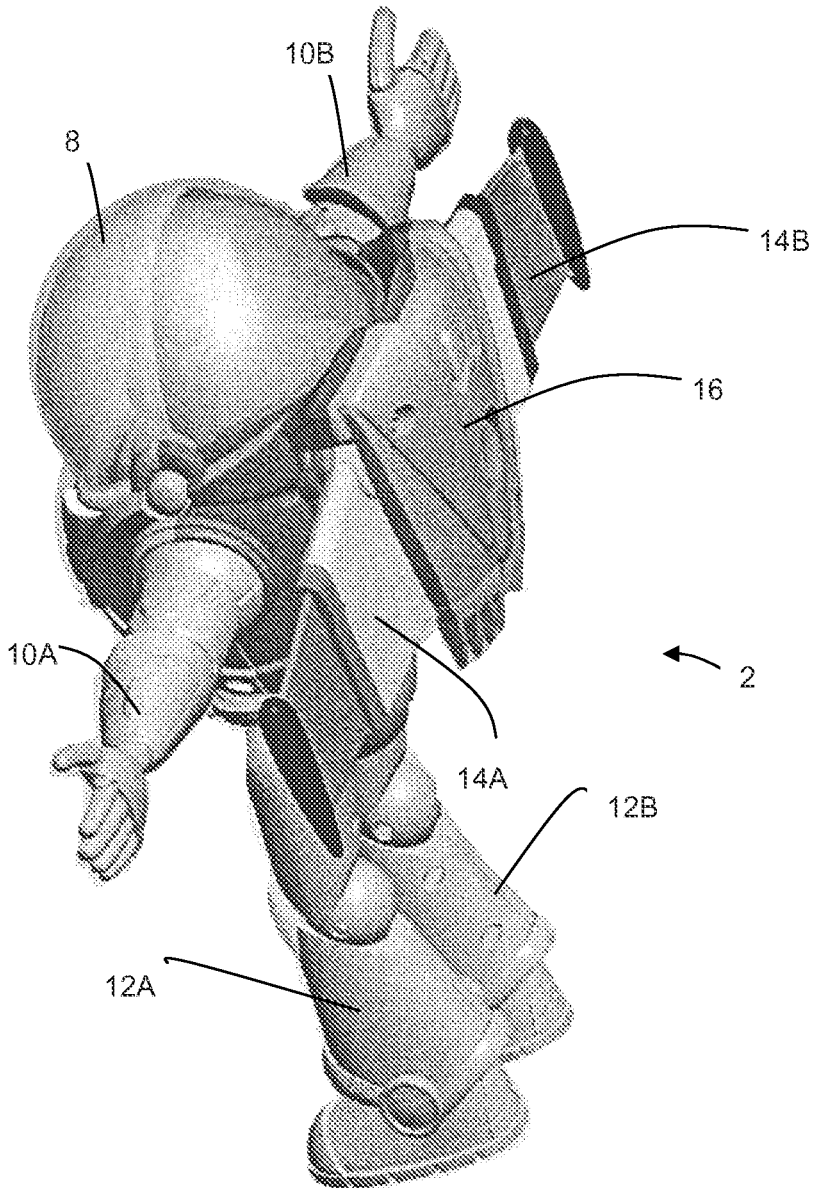
FIG. 6 is a side perspective view of the preferred embodiment, with the wings unfolded and extended, and the backpack cover in place.
Figure 9A:
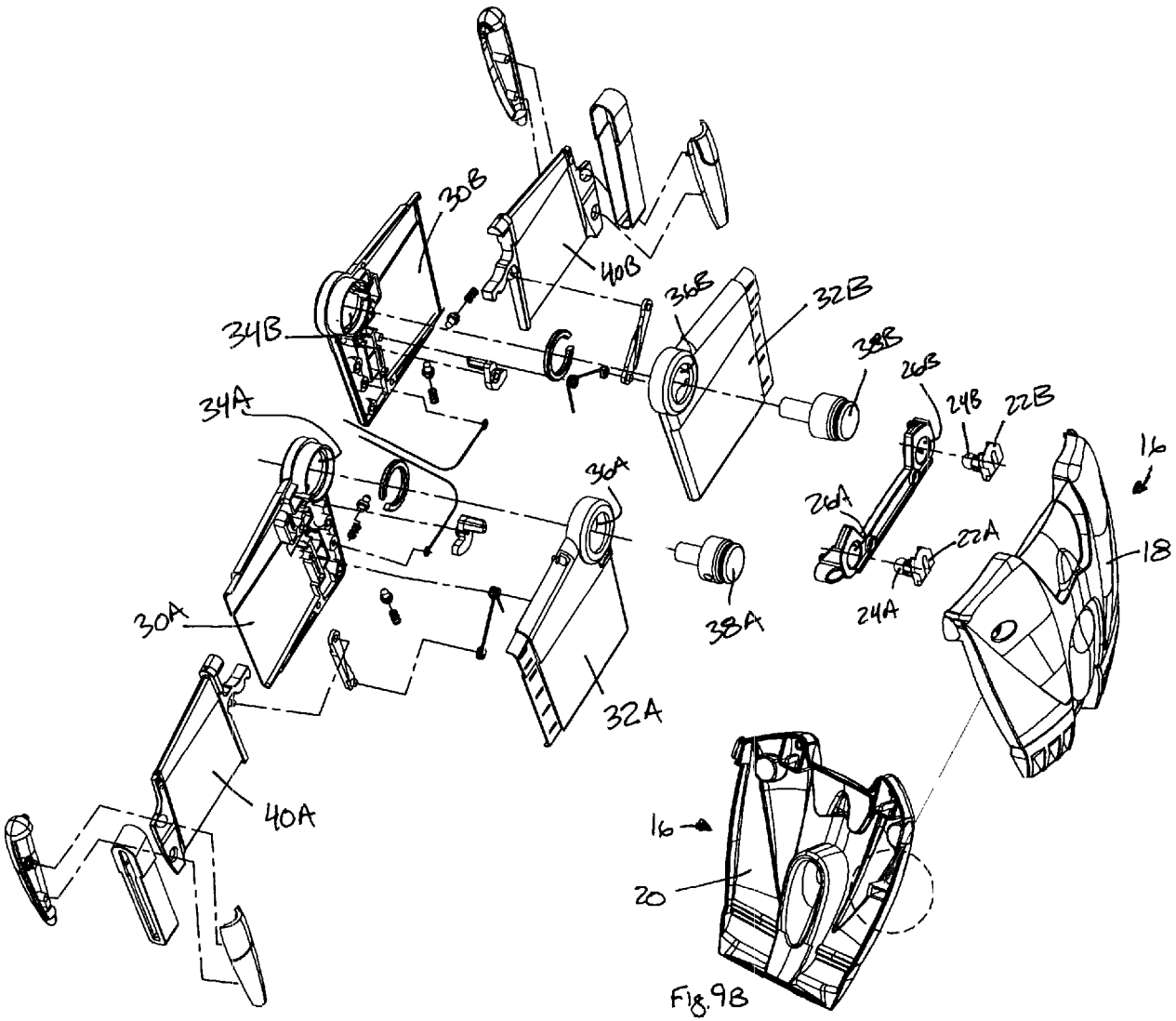
FIG. 9A is an exploded view of the wing section of the preferred embodiment, showing an outside surface of the backpack cover.
Figure 10:
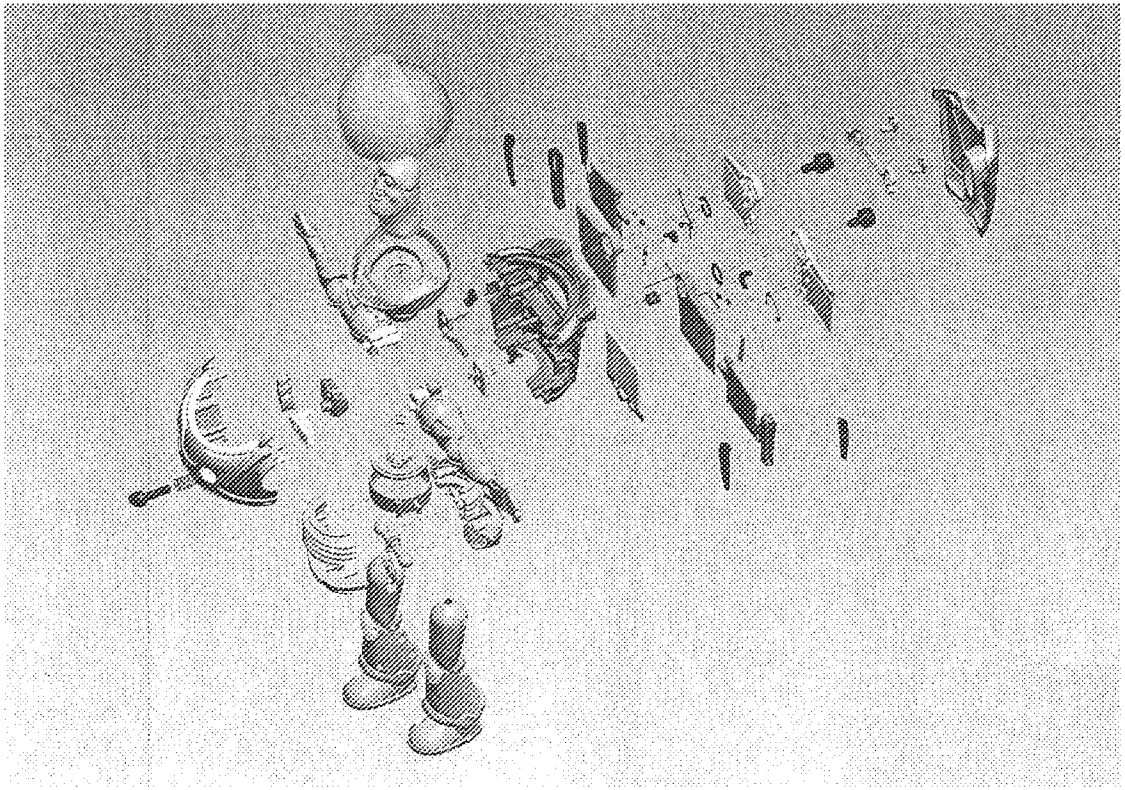
FIG. 10 is an exploded 3D view of a preferred embodiment.
Figure 11:
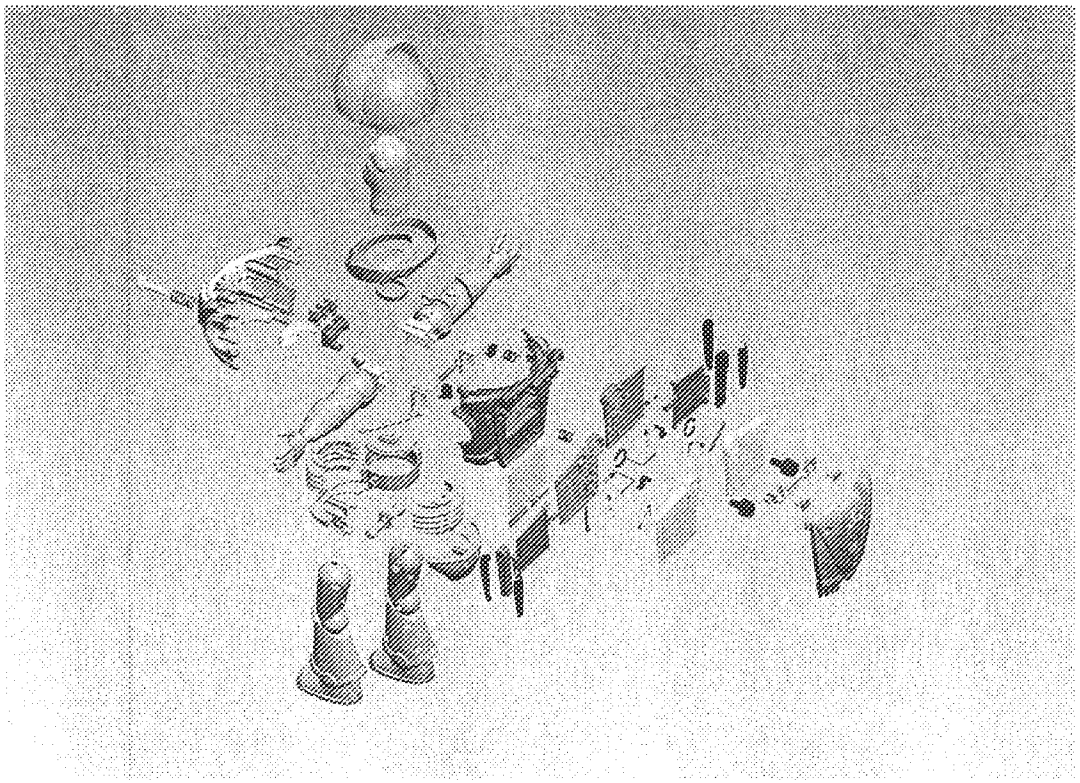
FIG. 11 is another 3D exploded view of a preferred embodiment.

In the preferred embodiment shown in FIGS. 4 to 6, the backpack cover 16 is positioned on the toy body so as not to impede the deployment (folding, unfolding, retracting, extending) of the wings 14A, 14B. As shown in FIGS. 9A and 9B, the backpack cover 16 has, attached to its inside surface 20, two pins 22A, 22B with spherical heads 24A, 24B (shown in FIG. 19). The spherical heads 24A, 24B releasably snap into appropriately sized respective resilient receptacles 26A, 26B fixed on the back of the toy body, to hold the backpack cover 16 in place. When access to the folded wings 14A, 14B and to the back of the toy body is desired, for example in order to access a battery compartment door or battery pack cover 28, the backpack cover 16 can be relatively easily snapped off by the application of an outward pulling force. The backpack cover 16 can be snapped back on by the application of a pushing force. The backpack cover 16 can also snap off by itself, without breakage, should the wings themselves snap off from the body for example resulting from abusive bending/twisting, or from high energy impact with a hard surface such as occurs when dropped on the floor.

Each individual wing 14A, 14B has an underside surface piece 30A, 30B and a top surface piece 32A, 32B. The respective underside pieces 30A, 30B have a respective underside piece aperture 34A, 34B. The respective top surface pieces 32A, 32B have a respective top surface piece aperture 36A, 36B. The respective underside surface pieces 30A, 30B are connected to the respective top surface pieces 32A, 32B with the respective apertures aligned. The wings 14A, 14B can pivot about articulation posts 38A, 38B which are positioned through the respective apertures to connect the respective wings 14A, 14B with the back of the toy body.

The wings 14A, 14B have respective wing tip sections 40A, 40B which slidably extend or retract from a space formed between the respective underside surface piece 30A, 30B and respective top surface piece 32A, 32B.

Figure 2:
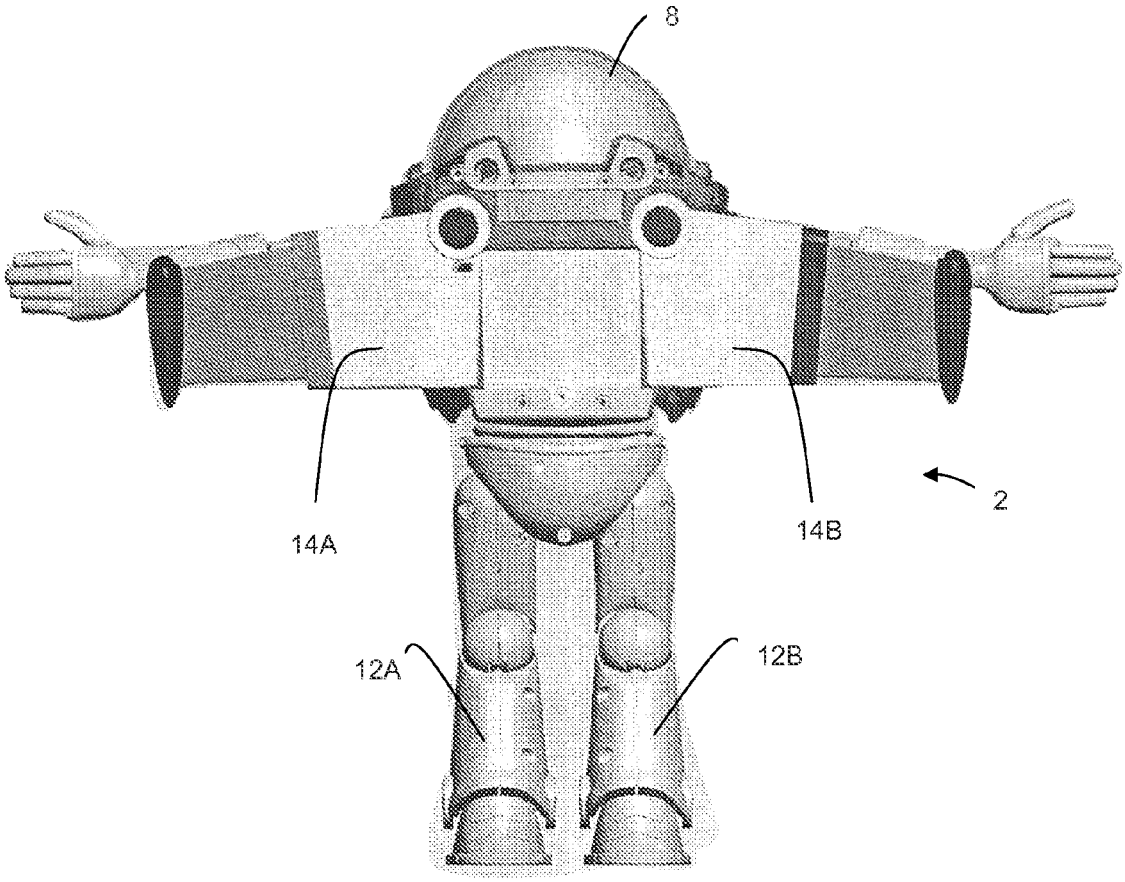
FIG. 2 is a rear elevation view of the preferred embodiment, with the wings unfolded and extended.
Figure 3:
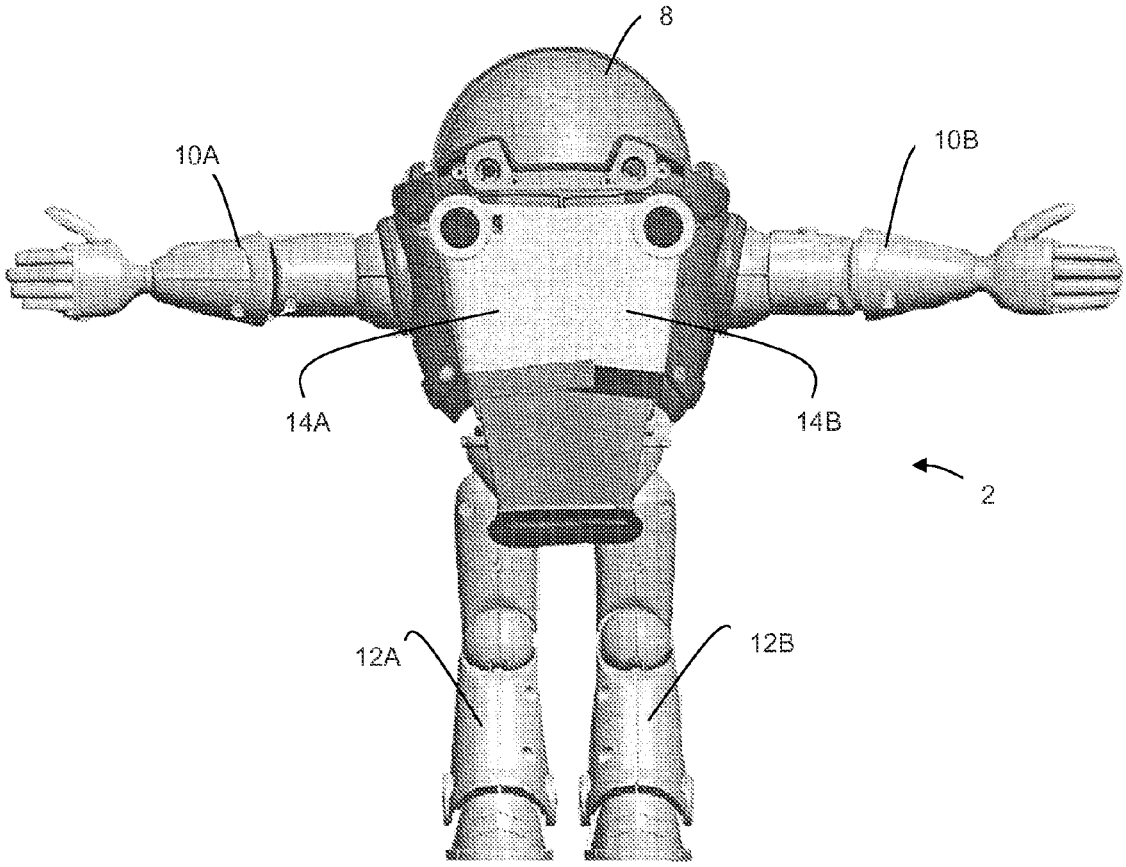
FIG. 3 is a rear elevation view of the preferred embodiment, with the wings folded and extended.

Several springs, latches and stopping mechanisms cooperate to define two stable angular positions of each wing 14A, 14B relative to the longitudinal axis of the body: a folded and an unfolded position. In the folded position shown for example in FIGS. 1 and 3, a wing's longitudinal (base to tip) axis is generally aligned with the longitudinal axis of the toy body. In the unfolded position shown for example in FIG. 2, a wing's longitudinal (base to tip) axis is generally at a transverse angle with the longitudinal axis of the toy body, resembling the position of an airplane wing relative to an airplane's body. The springs impart to the wings 14A, 14B a permanent bias toward the unfolded position, while the folding latches serve to retain the wings locked into the folded position. When folded, the wings are thus spring-loaded, and will spring into the unfolded position when the folding latches disengage.

For increased compactness with both wings 14A, 14B in the folded position, the pivoting articulations between the wings 14A, 14B and the body 4 allow and impart a slight movement on a direction perpendicular to the wings' angular rotation plane. When one wing is angularly rotated on its pivot towards its folded position, its pivot slides axially inward towards the body of the toy, to bring the folded wing slightly closer to the back surface of the toy. When the second wing is angularly rotated on its pivot towards its folded position, its pivot slides axially outward from the body of the toy, to bring the second folded wing slightly away from the back surface of the toy. The combined result of the two acts described above is that, when folding both wings, one wing is able to slide under the other wing and nest compactly thereunder. This helps maintain a streamlined body profile while accommodating wider wings on a narrower body, due to the increase in compactness of the wings' folded configuration.

Figure 19:
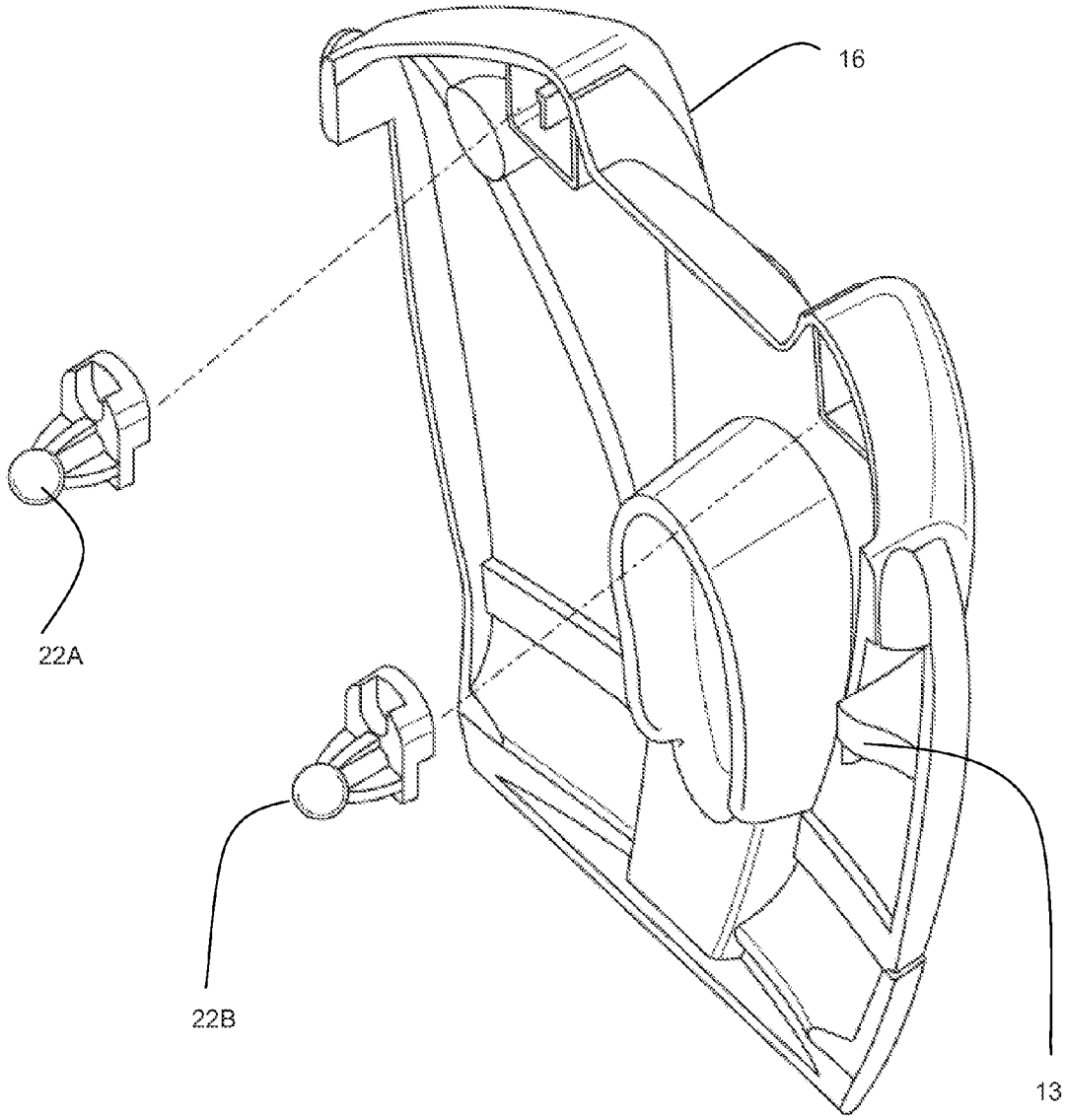
FIG. 19 is a rear elevation view of the back cover of the preferred embodiment.
Figure 21:
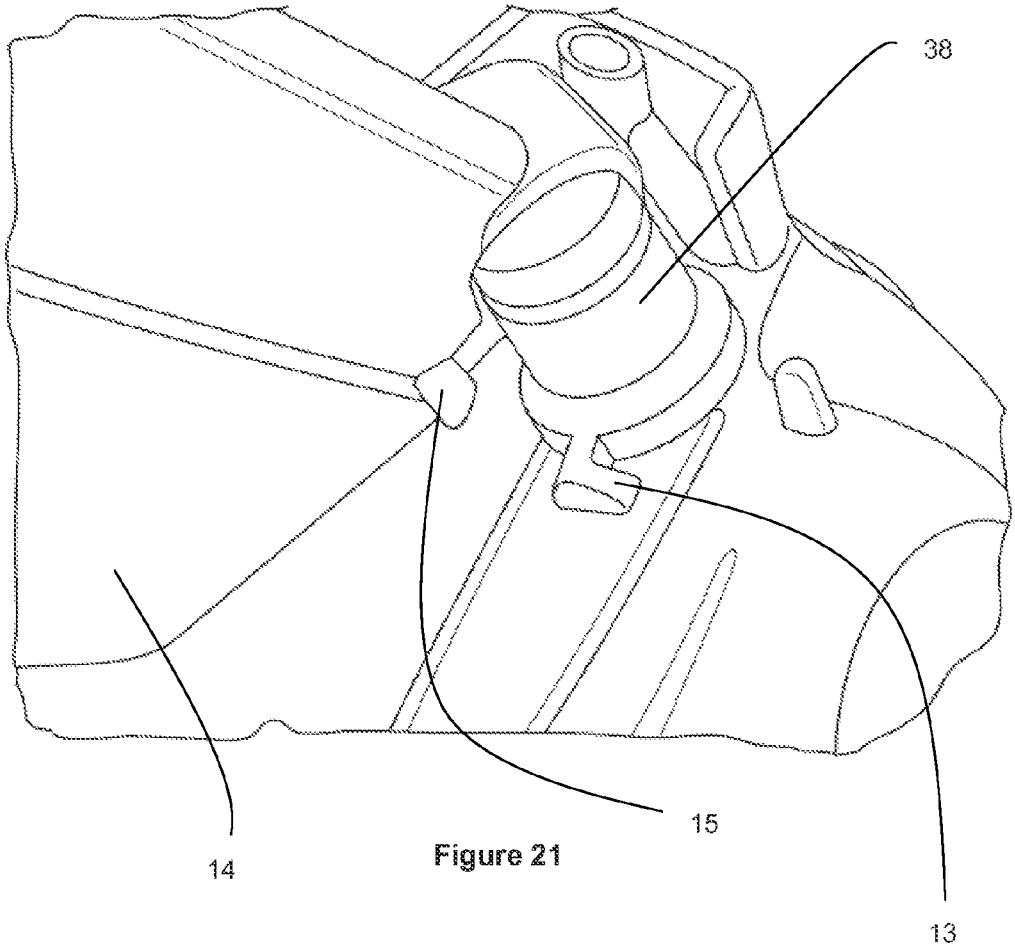
FIG. 21 is a perspective view of the underside of a wing that has been partially removed from the pivot articulation, so as to expose the functional features on the underside of the wing.

Independent from its angular position (folded/unfolded), each individual wing 14A, 14B is also retractable in length. Each wing is of a telescopic construction and consists of two sections: the base section, comprising the respective underside surface pieces 30A, 30B and the top surface pieces 32A, 32B and the tip section which telescopes from within the base section. Several springs, latches and stopping mechanisms cooperate to define two stable states for each wing: a retracted state, for example shown in FIG. 1, and an extended state, for example shown in FIGS. 2 and 3. The extension springs impart to each wing a permanent telescoping bias toward the extended state, while the retraction latches serve to retain a wing locked into the retracted state. The retraction latches have release levers 15 which protrude from the wing surface and which, when engaged, can release the latches and cause a wing to spring into its extended state. To engage these release levers 15, knobs 13 and protuberances are provided on the inside face of the backpack cover (as shown in FIG. 19) and/or on the back of the toy body. The knobs and protuberances are positioned so as to catch and engage the release levers 15 on the wings during the sweeping movement of the wings into their unfolded position. FIG. 21 shows a wing 14, partially removed from the pivot articulation 38 to expose the functional features of the underside of the wing 14, namely the retraction latch release lever 15 on the underside surface of the wing 14, a knob 13 that engages the retraction latch release lever 15, and a pivot articulation 38 that connects the wing 14 with the toy body.

Figure 12:
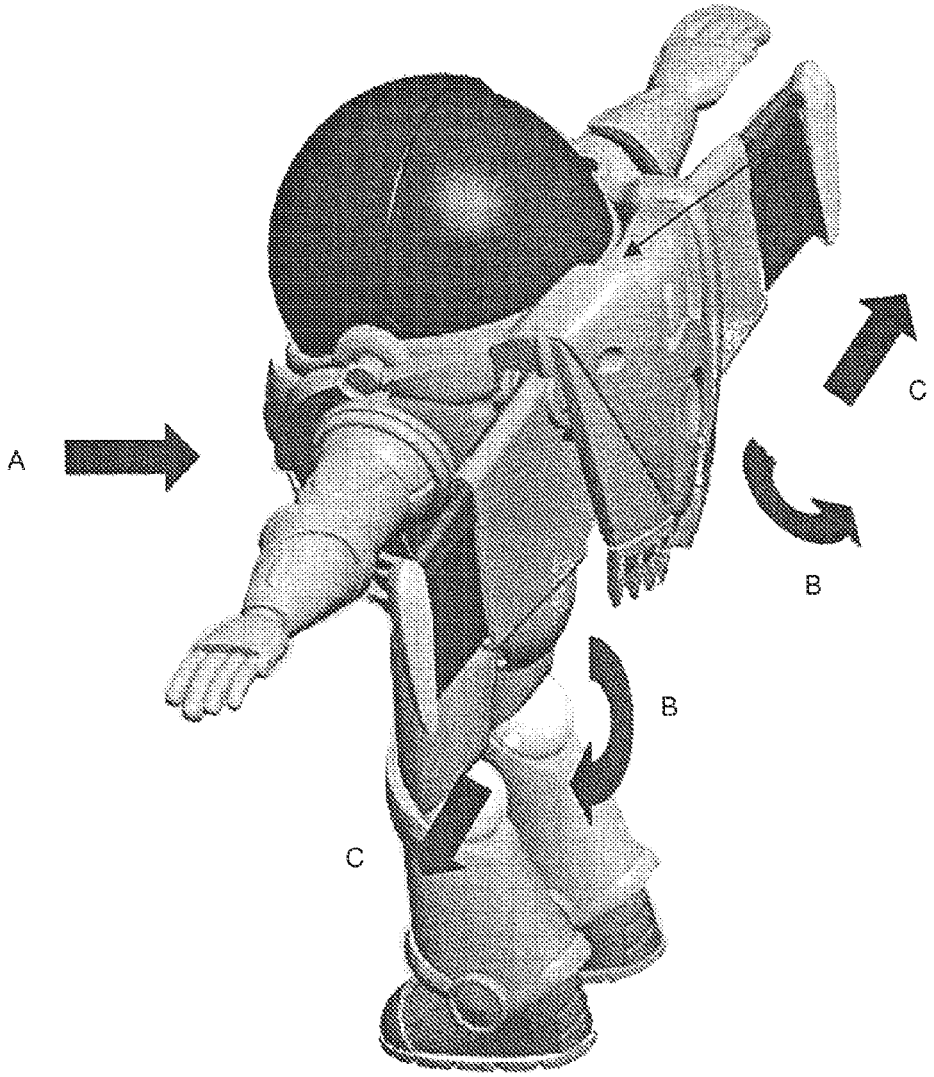
FIGS. 12, 13, 14, 15, 16 and 17 are rear elevation views depicting a typical sequence of positions of the wings, starting from a fully folded and retracted position, then fully unfolded and extended and then back to fully folded and retracted. Instructions and arrows are added to each image, to describe the movement of toy parts and the typical actions of the user.
Figure 13:
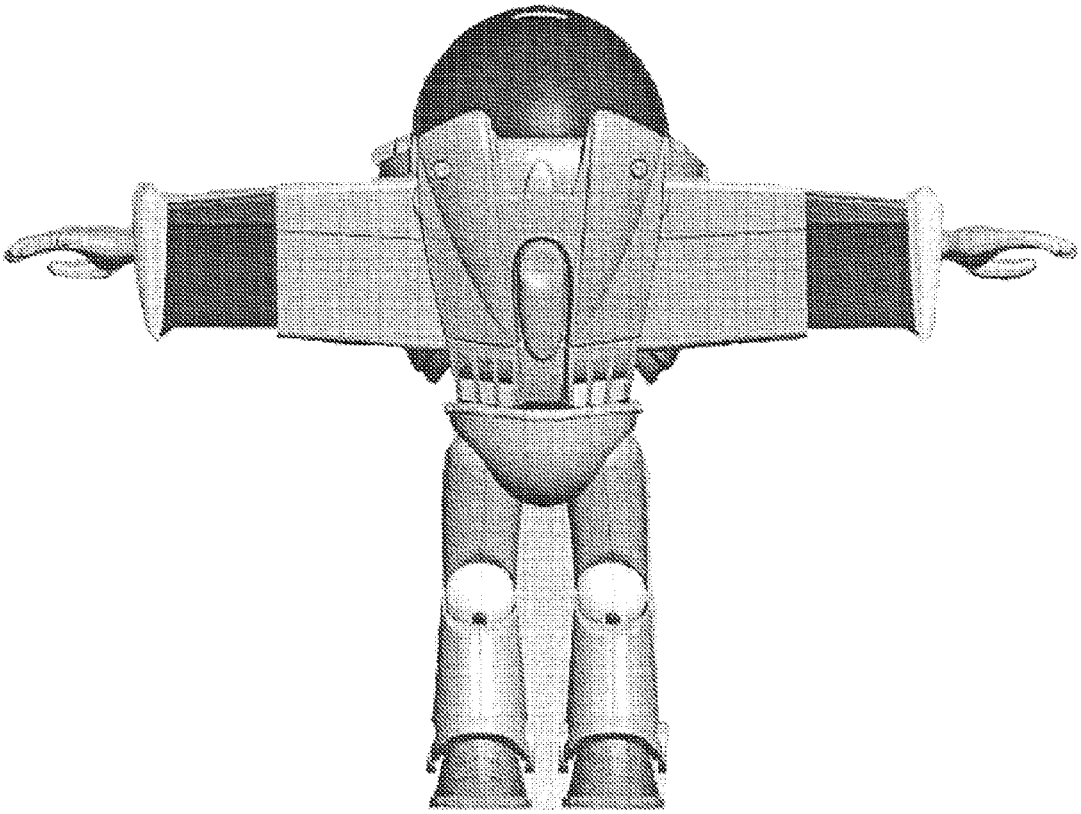
Figure 14:
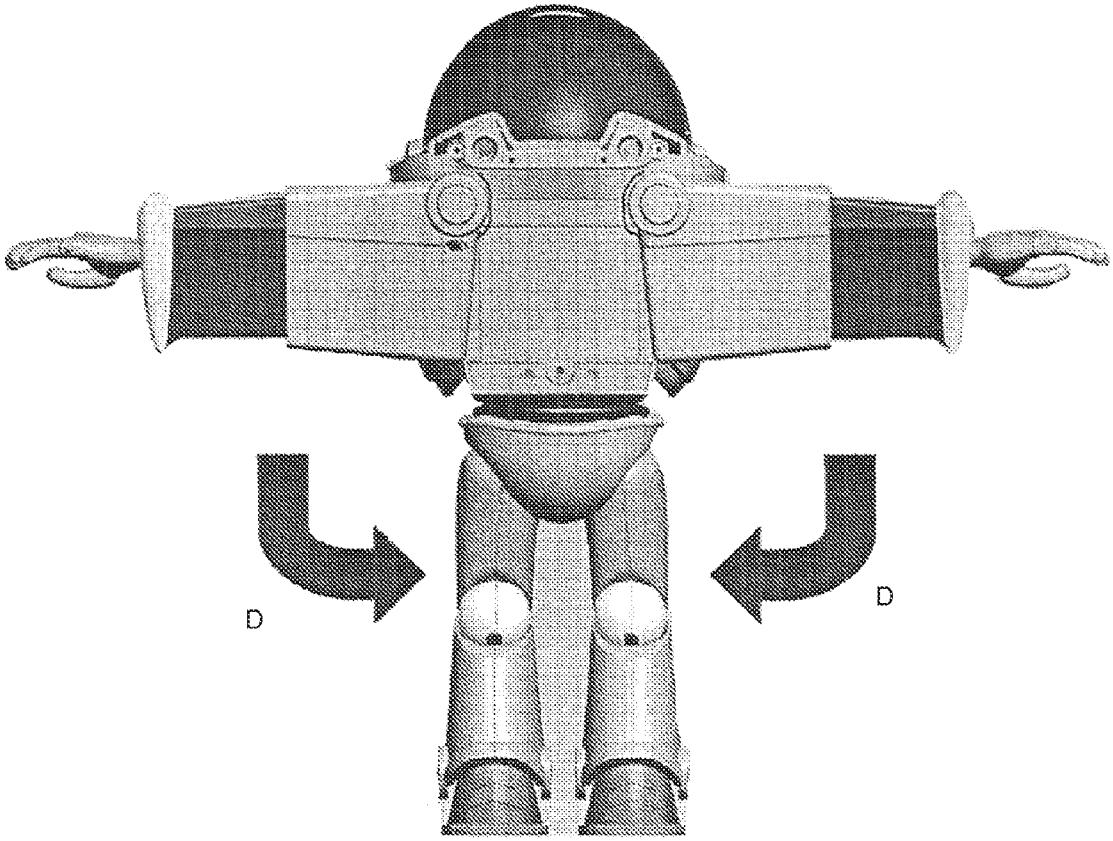
Figure 15:
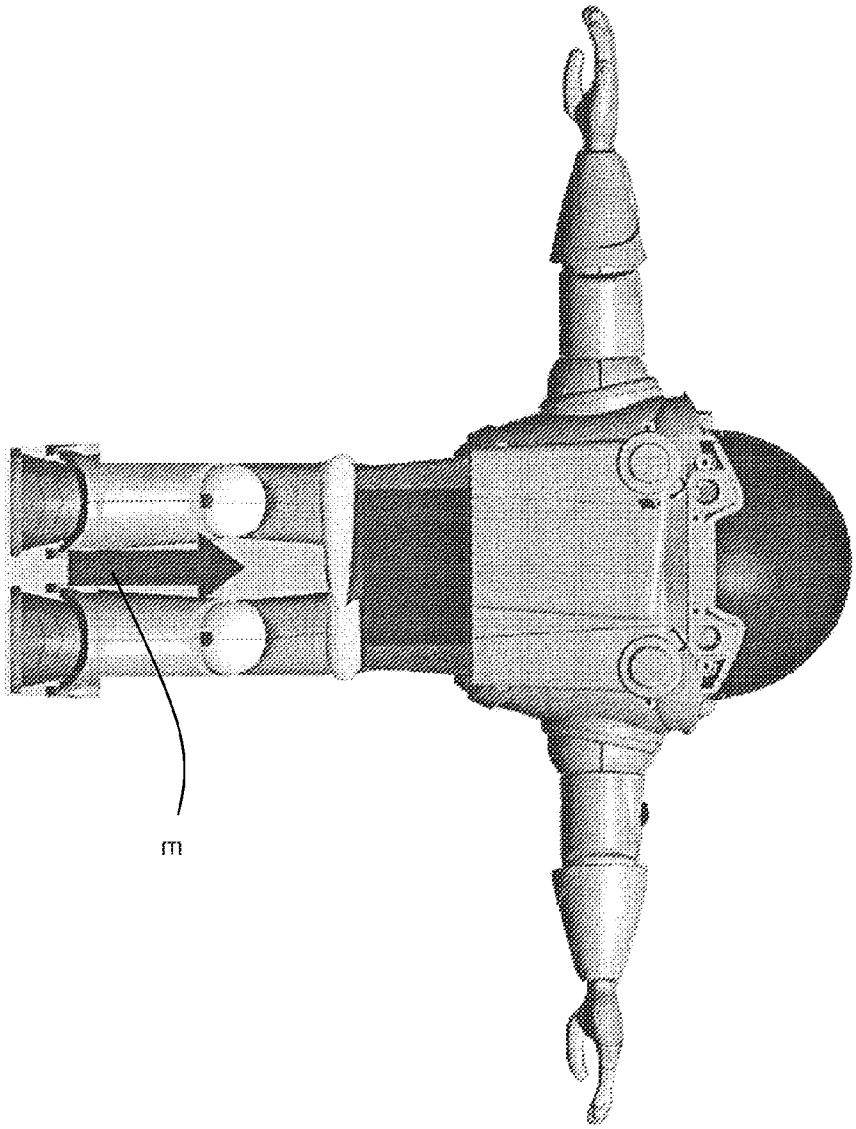
Figure 16:
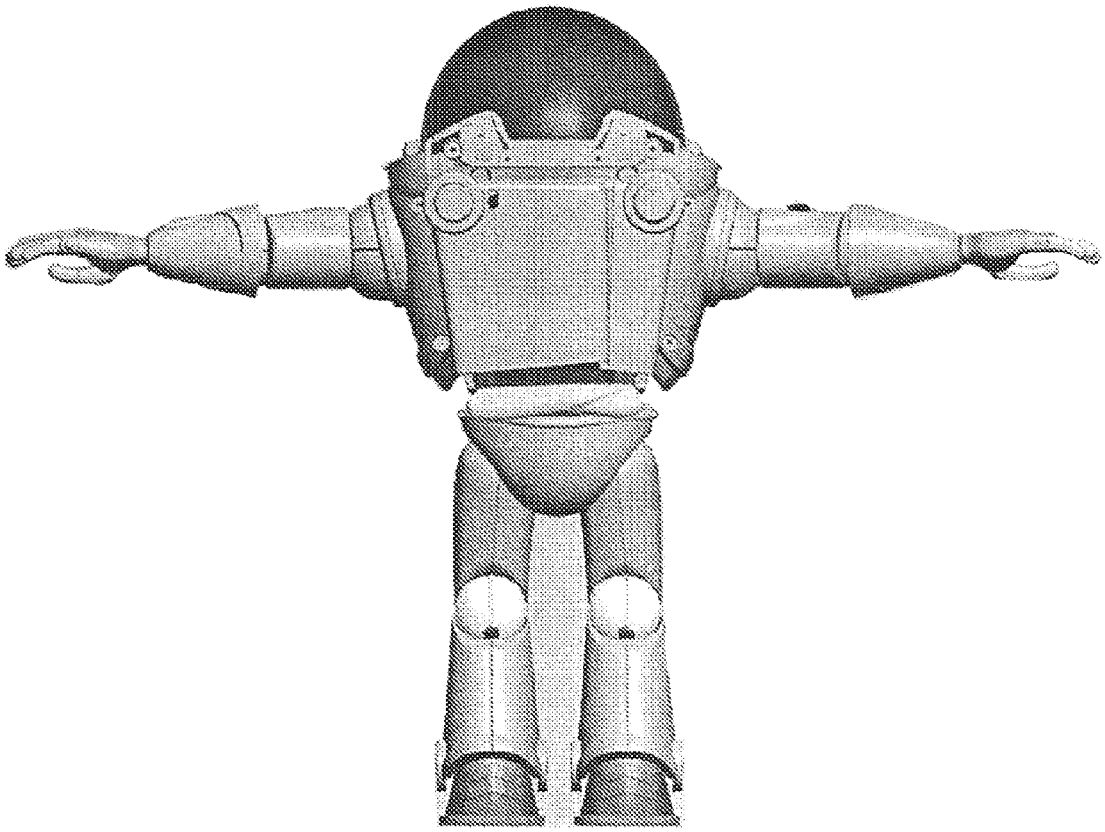
Figure 17:
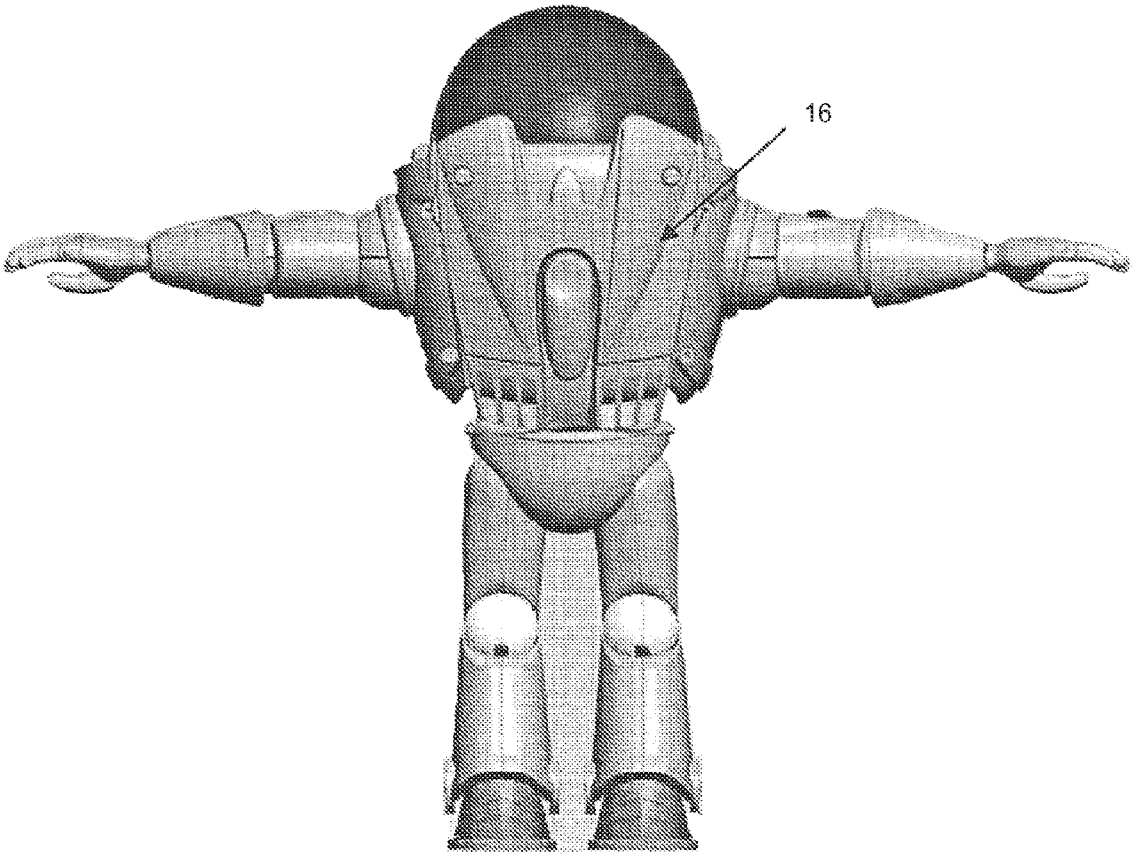

In a preferred embodiment, such as illustrated in FIG. 12, a user triggers the unfolding of the wings 14A, 14B by pressing a button 60 on a chest 62 of the toy to release the latch that holds the spring-loaded wings in the folded position. Pressing the button 60 is shown as action "A" in FIG. 12. Once the unfolding of the wings 14A, 14B is underway, knobs 13 and protuberances, positioned on the backpack cover and/or on the back of the toy body, engage the release levers 15 of the retraction latches on each wing, and automatically cause each wing to telescopically expand to its full extended length, without any extra input from the toy user. The swinging out of wings 14A and 14B is shown as action "B", and the popping out of wing tip sections 40A, 40B is shown as action "C" in FIG. 12. FIG. 13 shows the result of the actions of FIG. 12, with both wings 14A, 14B extended out. Turning now to FIG. 14, a toy according to an embodiment of the present invention is shown, with backpack removed and wings 14A, 14B fully extended. A user may then rotate both wings 14A, 14B inward until a click is heard, shown as action "D" in FIG. 14, and then push the wing tip sections 40A, 40B of the wings 14A, 14B upward until they are locked in position, shown as action "E" in FIG. 15. FIG. 16 shows the result of the actions of FIGS. 14 and 15, with both wings 14A, 14B locked, folded and retracted, and FIG. 17 shows the result of a user putting back the backpack cover 16.

Figure 18:
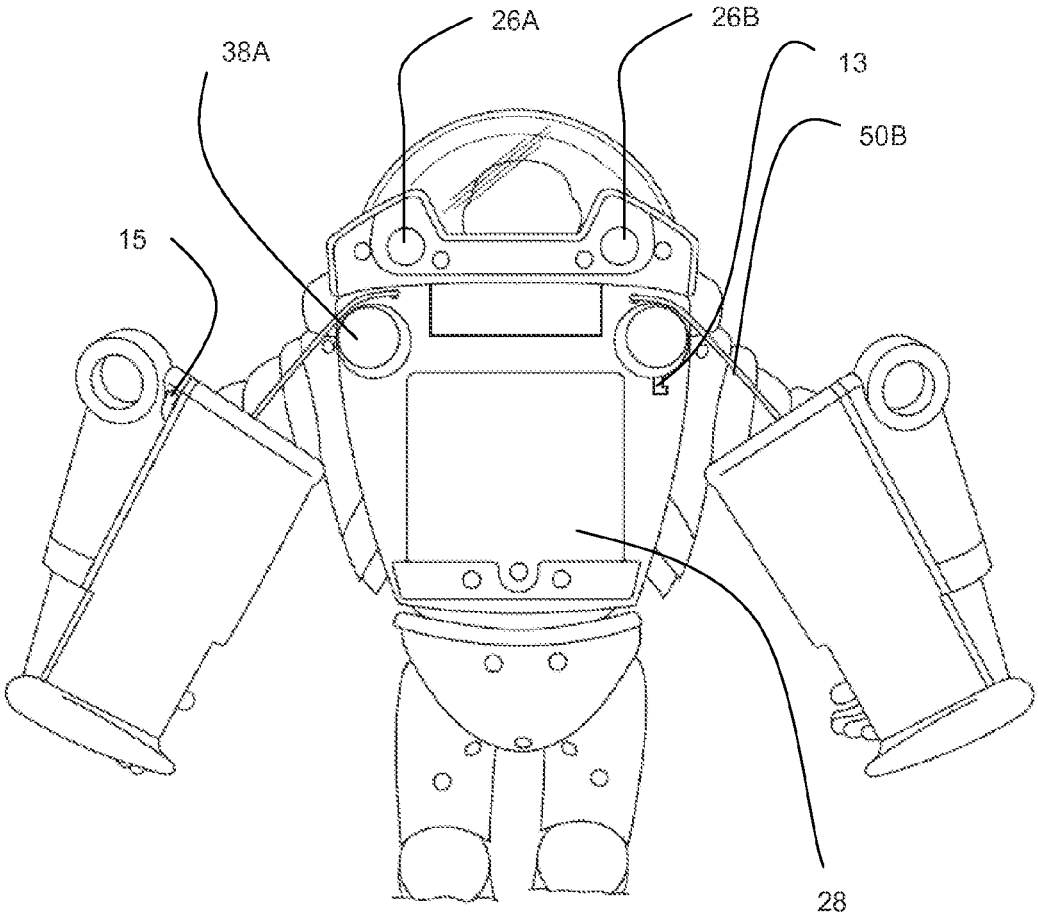
FIG. 18 is a rear elevation view of the preferred embodiment, with the wings extended and removed from the pivot articulations.

Turning now to FIG. 18, in a preferred embodiment, one wing has its retraction latch release lever 15 positioned on the underside surface of the wing (facing the back of the toy body) so that it could be engaged by a knob (not shown) placed on the body of the toy. The other wing has its release lever (not shown) on its top surface (facing the backpack cover) so that it could be engaged by a knob 13 placed on the inside face of the backpack cover. In alternative embodiments, the wings 14A, 14B can have their retraction latch release levers on either their underside or on their top surfaces, so as to be able to engage the corresponding knobs placed either on the inside of the backpack cover or on the body of the toy.

In an alternative embodiment, there is no button to trigger the spring-loaded unfolding of the wings 14A, 14B, and the user has to initiate the unfolding by pulling each wing outwardly until the latches on each wing disengage and each wing proceeds to complete its spring-loaded unfolding, followed by spring-loaded wing expansion into its extended state, as described in the previous paragraph.

Figure 20:
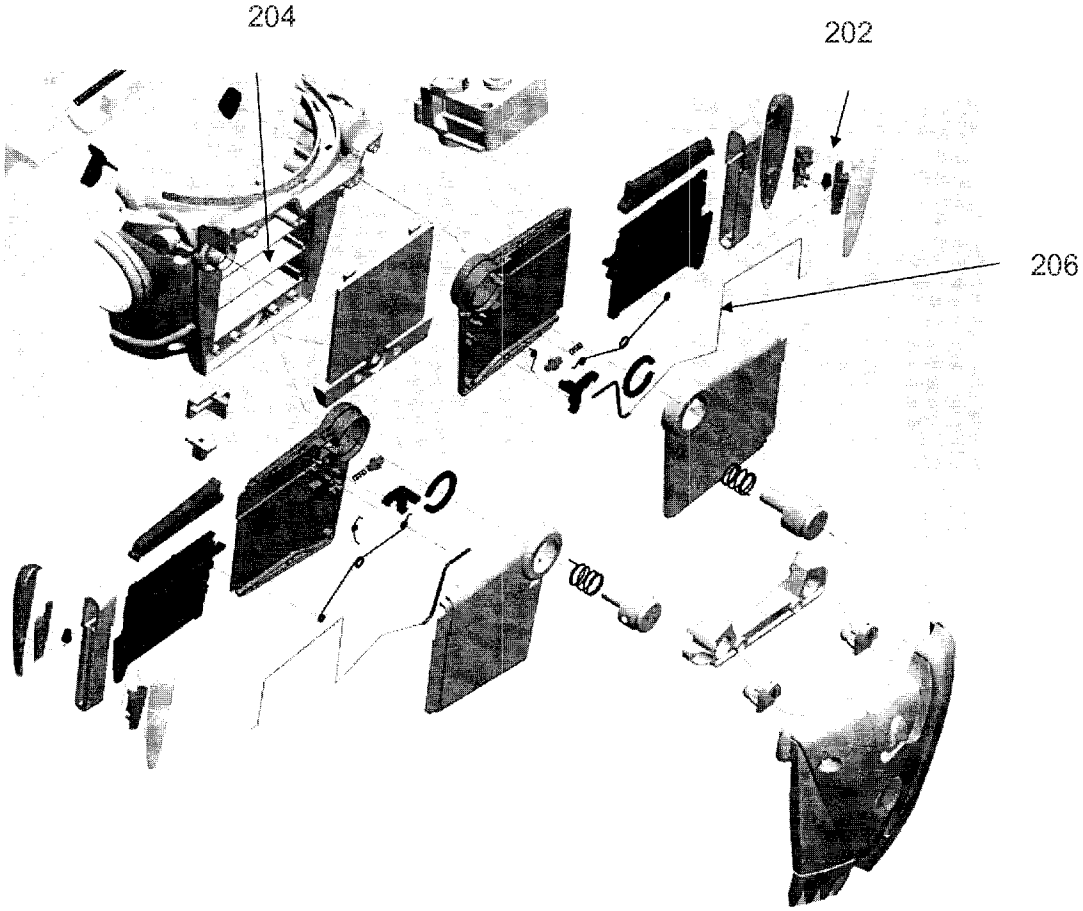
FIG. 20 is an exploded view of the wing section of an embodiment fitted with electric wingtip lights.

With reference to FIG. 20, in another alternative embodiment, the tips of the wings have operational electric lightbulbs or LEDs 202. Thin, flexible electrical cables 206, routed through the interior space of each wing, connect the wingtip lights with the battery pack 204 located preferably within the body of the toy. Integrated circuit means, also located preferably within the body of the toy, can be used to control the operation of the wingtip lights and of various other body lights and accompanying sounds. In another alternative embodiment, there is no integrated circuit, and simple contact switches turn on the wingtip lights upon wing deployment and turn off the lights when the wings are folded and retracted.

Retracting and folding back the wings 14A, 14B is done manually in all embodiments, by rotating each wing inward until the folding latches on each wing engage, followed by pushing the tip section of each wing into its base section until the retraction latches on each wing engage.

The pivoting articulations between the wings and the toy body are constructed to allow snap-in-place assembly and disassembly of the articulation, without the need to use any tools or an excessive force beyond what a typical user of the toy (a child) would possess. The pivoting articulations are constructed to withstand high mechanical stress and to provide crisp, precise movement during wing unfolding, as well as robust rigidity during energetic operation of the toy with the wings in a fully extended position. However, the pivoting articulations between the wings and the toy body are designed to automatically release (i.e., snap off) the wings from the pivot articulation in the event that the mechanical stress load would approach a level that could cause breakage or destructive disassembly of the wing components, such as upon abusive bending/twisting, dropping the toy on the floor, or other high energy impact with a hard surface. The backpack cover 16 is also designed to snap off whenever one of the wings 14A, 14B is released from the pivot articulation, thus ensuring that a wing 14A, 14B becomes non-destructively detached from the toy body well before the stress load would cause that wing 14A, 14B to break.

Figure 7:
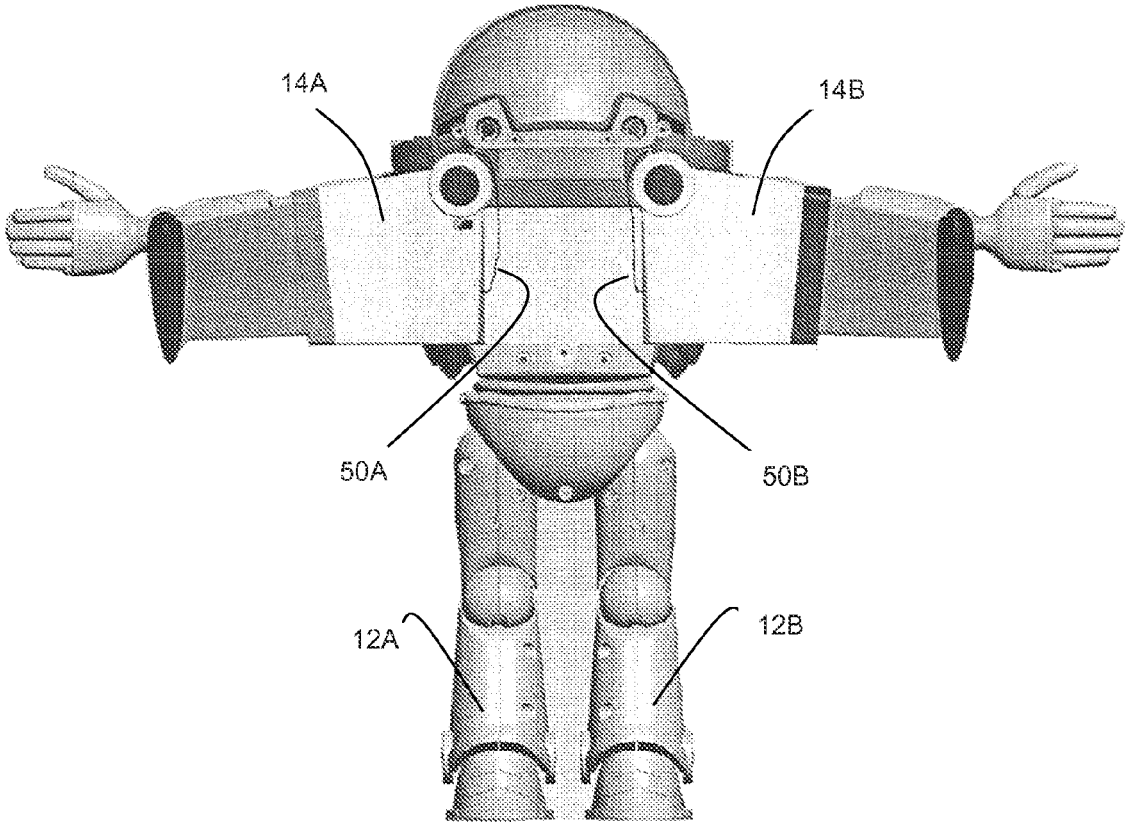
FIG. 7 is a rear elevation view of an alternative embodiment, showing the strings tethering each wing to the toy body.
Figure 8:
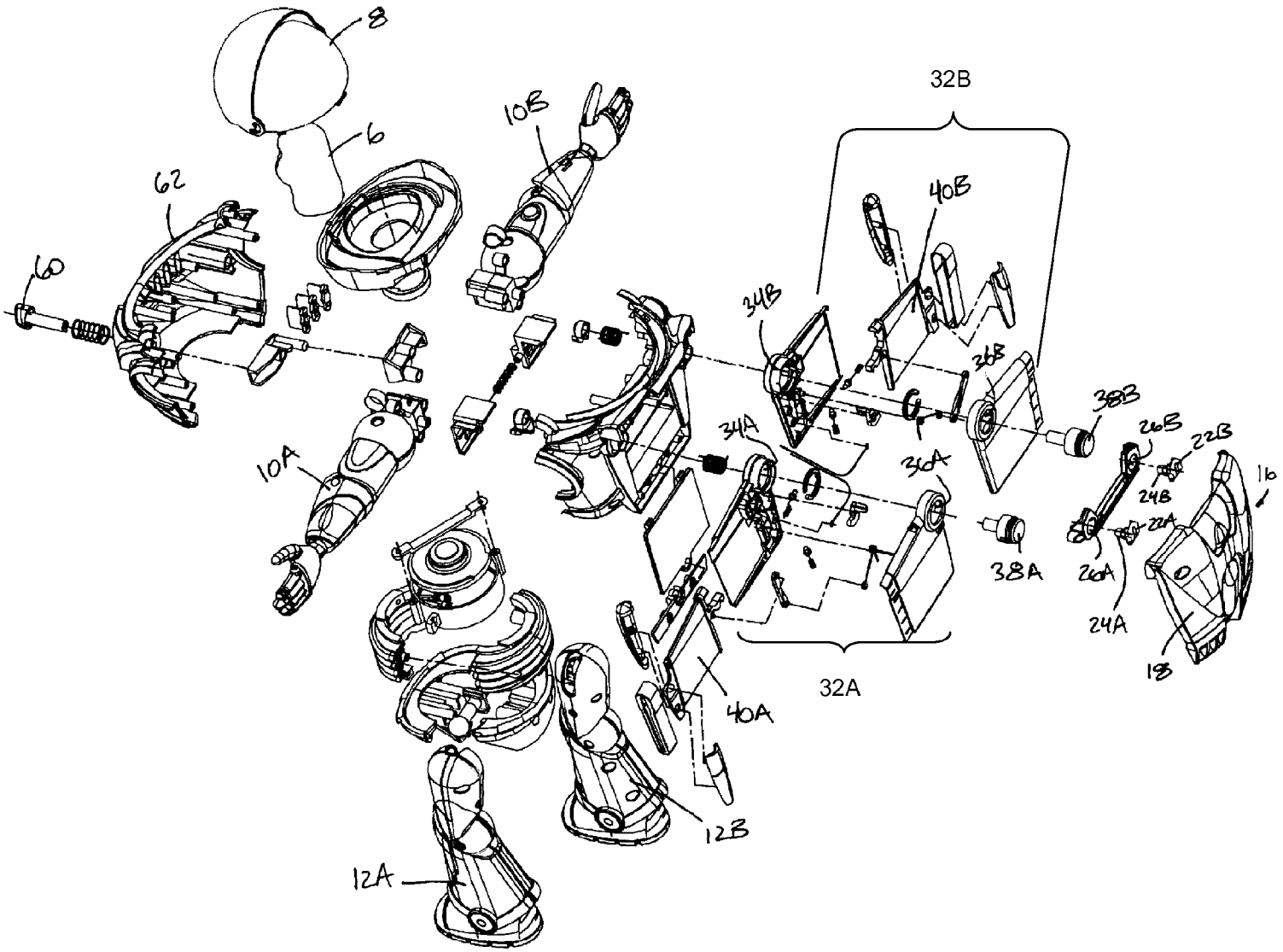
FIG. 8 is an exploded view of the preferred embodiment.

This precise, non-destructive, safety release action allows the toy to be fitted with long, thin and lightweight rigid wings constructed of common and inexpensive plastics, yet it allows the toy to pass all safety and drop tests designed to ensure that the toy is resistant to breakage or that its breakage will not result in sharp edges. After any incident resulting in such a safety release of a wing from the pivot articulation, the toy can be easily reassembled into its original configuration by snapping back in place any part that previously snapped off, for example the wings 14A, 14B or the backpack cover 16. Furthermore, in a preferred embodiment such as shown in FIG. 7, the respective wings 14A, 14B are unobtrusively tethered to the body by a length of thin string 50A, 50B that ensures that a detached wing cannot be lost, misplaced or taken away from the general proximity of the toy 2. In an alternative embodiment, the tethering string 50A, 50B can be omitted. In another alternative embodiment, the reinforced, thin, electrical wires connecting the wingtip lights with the battery pack inside the toy's body can also serve the role of tethers for the wings.

It will be apparent to those skilled in the art, after reviewing this description, that many changes, modifications, variations and other uses and applications for the subject folding and retractable wing toy, in addition to those which have been disclosed are possible and contemplated, and all such changes, modifications, variations and other uses and applications which do not depart from the spirit and scope of the invention are deemed to be covered by the invention which is limited only by the claims which follow.

The invention claimed is:

1. A toy comprising:

a) a body;

b) a first wing and a second wing both having a folded position and an unfolded position;

c) an articulation member for moveably and releasably connecting said first and second wings to said body, said articulation member is adapted to allow said first and second wings to pivot between said folded and said unfolded positions, when in said folded position the first and second wings are in a space minimizing nested configuration with the first wing positioned below the second wing and when in said unfolded position the first and second wings extend from the body opposite to each other, said articulation member is adapted to reversibly release said connection during the application of a high mechanical stress on either of said first and second wings when the stress approaches a level that could cause breakage or destructive disassembly of the toy, said articulation member is adapted to receive said first and second wings in a snap-in configuration and to reform said connection.

2. The toy according to claim 1 further comprising a tethering member for permanently tethering said first and second wings to said body, to prevent a complete separation of said first and second wings from said body when said articulation member releases said connection between said first and second wings and said body.

3. The toy according to claim 1 wherein said first and second wings each can move between a retracted state and a telescopically extended state, the toy further comprising:

a) a first retention latch that is substantially located within said wings to lock said first and second wings in said retracted state;

b) a second retention latch that is substantially located within said body to lock said first and second wings in said folded position;

c) a first biasing member to urge said first and second wings to said extended state when not locked by said first retention latch;

d) a second biasing member to urge said first and second wings to fully said unfolded position when not locked by said second retention latch; and e) a deployment member for automatic release of said first retention latch when said first and second wings move from said folded position into said unfolded position.

* * * * *